US007299745B2

(12) United States Patent
Nelson et al.

(10) Patent No.: US 7,299,745 B2
(45) Date of Patent: Nov. 27, 2007

(54) HORIZONTALLY POSITIONABLE VERTICAL WINE PRESS

(75) Inventors: Ned Nelson, Bellevue, WA (US); Ross Mickel, Bellevue, WA (US)

(73) Assignee: American Basket Press Company, Inc., Bellevu, WA (US)

( * ) Notice: Subject to any disclaimer, the term of this patent is extended or adjusted under 35 U.S.C. 154(b) by 0 days.

(21) Appl. No.: 11/027,455

(22) Filed: Dec. 30, 2004

(65) Prior Publication Data

US 2005/0139093 A1 Jun. 30, 2005

Related U.S. Application Data

(60) Provisional application No. 60/533,446, filed on Dec. 30, 2003.

(51) Int. Cl.
*B30B 9/06* (2006.01)

(52) U.S. Cl. ..... 100/110; 100/100; 100/126; 100/131; 100/135; 100/229 A; 210/224; 210/225; 210/498; 99/277; 99/349

(58) Field of Classification Search ..... 100/100, 100/104, 107, 110, 113, 116, 125, 126, 127, 100/128, 130, 131, 132, 133, 134, 135, 214, 100/221, 224, 226, 227, 229 A, 240, 229 R, 100/248, 295; 99/277, 277.1, 349; 210/224, 210/231, 498, 225

See application file for complete search history.

(56) References Cited

U.S. PATENT DOCUMENTS 179,615 A * 7/1876 Schiller ..... 100/125
697,251 A * 4/1902 Hubbell ..... 100/116
784,183 A * 3/1905 Schaffer ..... 100/107
1,631,585 A * 6/1927 D'Olier et al. ..... 210/498
2,221,806 A * 11/1940 Loomis ..... 34/331
2,403,784 A * 7/1946 Bradshaw ..... 100/131
5,213,695 A * 5/1993 Pinder ..... 210/767

* cited by examiner

*Primary Examiner*—Jimmy Nguyen
(74) *Attorney, Agent, or Firm*—Merchant & Gould; David L. Garrison

(57) ABSTRACT

A juice press as used in the production of wine for removing liquids from solids, having a horizontally positionable press frame that allows a vertical press mechanism to be rolled to a first position for interference-free loading of a press basket with material to be pressed, and then rolled to a second operating position located over the press basket. The press basket has a liquid channeling plate having an arrangement of holes and channels that creates a perimeter seal along a circumference at the bottom of a loaded press basket. The liquid channeling plate traps naturally occurring sludge along the circumference bottom and allows for efficient evacuation of extracted juice from the bottom of the basket as the press mechanism is operated. In one embodiment, the press frame is configured with a hydraulic press basket lift that raises and holds the press basket after a press operation is completed and allows the press mechanism to be used to eject a disk of compressed solids from the bottom of the raised press basket.

14 Claims, 9 Drawing Sheets

HORIZONTALLY POSITIONABLE VERTICAL WINE PRESS

CROSS-REFERENCE TO RELATED APPLICATION

This application claims benefit of U.S. Provisional Application Ser. No. 60/533,446 entitled A Horizontally Postionable Vertical Wine Press, filed Dec. 30, 2003.

TECHNICAL FIELD

This invention relates generally to a juice press, especially a wine or fruit press, and to a process for making juice or wine from grapes, fruit, or like material to be pressed. Particularly, this invention relates to a wine press having a horizontally positionable press frame that allows a vertical press mechanism to be rolled to a first position for interference-free loading of a press basket with material to be pressed, and then rolled to a second position located over the press basket for performing pressing operations and then ejecting a cake of resulting solids. This invention further relates to a wine press having a liquid channeling plate that creates a perimeter seal along the bottom of the press basket and allows for efficient evacuation of pressed juice from the bottom of the basket as the press mechanism is operated.

BACKGROUND OF THE INVENTION

Wine is typically made by crushing and de-stemming grapes and then extracting color and flavor components from the grape skins and pulp by allowing the crushed grapes, including their juice, to sit for a period of time referred to as an extraction period. This extraction period is followed by or is part of a fermentation stage where yeast introduced to the mixture converts the sugars in the grape juice to alcohol and carbon dioxide. The fermentation can also facilitate in extracting flavor and color from the skins. This process is often referred to as "maceration." The liquid or partially fermented grape juice, referred to as "must", is typically pressed from the skins, stems, and other solids, collectively referred to as "pomace," and transferred to a secondary vessel for further processing.

During the extraction period the large solids typically float to the surface of the crushed grapes to form a "cap." This cap can be relatively thick and portions can partially dry out, which diminishes extraction. If fermentation is occurring, the carbon dioxide formed by the yeast can also carry solids to the surface because the gas bubbles nucleate on the solids and carry them to the top of the liquid.

In order to improve the extraction of flavor and color, the cap can kept moist by a number of techniques including manual methods used by the winemaker to push portions of the cap into the must. The resulting combination of must and pomace is a non-homogenous mixture of liquids and solids that must be separated by press operation on completion of the fermentation period.

Press operations of grapes and other vegetable substances have been traditionally carried out using vertical presses of a screw or hydraulic type, or horizontal presses of that perform compression by means of an inflatable diaphragm or compression by means of opposing circular platens, the displacement being provided by cylinders or screws.

A vertical press typically includes a perforated basket, drum or like container having slots, holes or like flow openings in its longitudinal walls, and further includes a mechanical or hydraulic-powered press mechanism that applies pressure to the mixture within the basket, thus forcing the liquid out of the basket openings. The liquid is collected in a press pan that is located immediately beneath the basket, the pan having a spout or valve that allows the liquid to be retained within the press pan and, when desired, to then be transferred for further processing or to a storage container.

The press operation is typically conducted in batches limited to the size of the basket. Each batch must be separately loaded into the basket and placed under the press mechanism, or loaded into a basket already located under the press. A problem encountered with this process is that the must will begin to flow freely under its own weight from the basket openings as soon as the must and pomace mixture is introduced to the basket, resulting in waste. Furthermore, should the extracted liquid volume exceed the capacity of the press pan, additional waste results when the press pan overflows.

The risk of overflow and loss of valuable product is increased with the additional delays of positioning the basket beneath the press, or by attempting to load an already positioned basket while working around the interference created by the press mechanism. Filling a basket prior to placement under the press can also result in loss of product as the liquid in the rapidly filling press pan splashes over the edges during transport. Further processing delays can occur as the basket is removed for disposal of the resulting compressed solid material.

A second problem arises in the press operation in that uneven pressures are produced within the mass of non-homogenous must and pomace as pressure is applied by the press mechanism. Pockets of liquid become trapped within the compressing mass, which increasingly acts as a solid that is impervious to the liquid trapped within. As pressure from the press is increased, the liquid in these pockets can eventually be forcefully ejected laterally, often times creating further waste of product, creating problems of workplace cleanliness, and raising the possibility of injury.

Another problem with the press operation is the existence of sludge that naturally forms as heavier particulate matter settles within the must and pomace mixture, particularly in the lower portion of the basket and press pan prior to pressing. Sludge is troublesome in that it can contaminate the outflowing liquid and otherwise foul filters and pumps, resulting in waste, production inefficiencies, and undesirable wine characteristics.

A wine maker will often sample the outflowing liquid and will stop the press operation when the characteristics of the liquid become undesirable. While wine presses of the prior art are typically equipped with a press mechanism, a press basket, and a press pan to collect the extracted liquid, there remains a need for an additional reservoir that would allow the wine maker to hold an entire batch of liquid, or a substantial portion thereof, from the press before transferring it to a holding vessel. An additional reservoir would allow the wine maker the ability to chemically treat the liquid as one lot before transferring the it to a barrel, the option of blending the various flavors extracted at different phases of the press cycle before transferring the liquid to a barrel, and the ability to ascertain the quality of the entire batch of liquid before transferring the liquid for further processing or storage.

Inspection of visual quality of extracted liquid is especially important for making white wine, where it is desirable to visually ascertain and inspect the clarity and percent of suspended solids in the fluid at the time of pressing. Unlike the process for making red wines, white wine usually requires that the grapes be placed directly in a basket press "whole" to extract the liquid before fermentation begins. The basket press then does the initial liquid extraction instead of the crusher de-stemmer as for red wine. The white wine maker needs to know how much suspended solid is in the white grape juice, often by making a visual assessment of the extracted liquid and before the liquid is transferred to other containers for fermentation.

Press operations for extracting liquids from suspended solids, using either vertical or horizontal presses, results in a disk of compressed solid matter within the press basket, referred to as a "cake," and requires removal from the basket prior to the winemaker's refilling the basket for the next extraction cycle.

Following each extraction cycle in earlier wine presses, it was necessary to perform a manual breaking-up operation using shovels and forks to dislodge and remove the cake. On pneumatic horizontal presses, the breaking-up operation is performed mechanically, by rotation of the basket, after decompression of the diaphragm. On horizontal presses with compression by means of opposing circular platens, this operation is carried out by rotation of the basket together with retraction of the platens. Although mechanization of the breaking-up operation has dispensed with laborious manual interventions, it has introduced crushing and grinding processes which impair quality through introduction of undesirable sludge and turbidity.

U.S. Pat. No. 4,730,555 teaches a wine press with horizontally oriented rotatable platen that provides for an extraction process that, when the substance to be pressed is introduced into the basket or cage, a perforated rotating horizontal circular platen allows for uniform distribution of the substance. After closure of the basket, the two thrust platens are brought together in successive pressure stages until the desired degree of extraction is obtained. The final cake forming the residue is then removed under its own weight. While this invention provides a means of removing a resulting cake following a press operation, it does not address the issues involved for cake extraction using a vertical press and the loss of product as a basket is loaded or positioned in preparation for pressing. This invention further does not address the extraction of trapped pockets of fluid that may exist within a mass of compressing substance.

U.S. Pat. No. 5,927,187 teaches a wine or fruit press having a drum or similar container having slots, holes or similar flow openings in its longitudinal sides and a feed plat or similar component longitudinally movable inside the container. This invention provides improved press efficiency and low sludge content over prior art but does not address the need for the issues involved for cake extraction using a vertical press and the loss of product as a basket is loaded or positioned in preparation for pressing. This invention further does not address the extraction of trapped pockets of fluid that may exist within a mass of compressing substance.

Some commercially available wine presses are equipped with casters on the press frame base, and a separate frame for supporting a press basket and press pan that is also equipped with casters, for independently positioning the press and the press basket. Problems of liquid overflow and losses due to positioning of the press and press basket are not sufficiently addressed by these presses.

OBJECTS OF THE INVENTION

It is an object of this invention to overcome the disadvantages exhibited by the presses of the prior art by providing a juice press, particularly a press as used in the production of wine, having a horizontally positionable press frame that allows a press mechanism to be rolled to a first position for interference-free loading of a press basket, and then rolled to a second operating position located over the press basket where a press process is conducted.

As a basket is filled with a mixture of must and pomace at the start of a press procedure, the liquid in the must will free-flow from openings in the basket and will be retained in a press pan in which the press basket sits. It is an object of the present invention to minimize the possibility for overflow of the press pan through improved efficiencies obtained by providing a basket that can be top-loaded while the basket is seated into the press pan, and then quickly and easily positioning a vertical press mechanism over the basket to begin the press procedure.

Another object of the present invention is to provide for a liquid channeling plate having a plurality of holes extending through the plate, and a like number of radially oriented channels cut into the bottom of the plate that provide a continuous opening from each hole to the outer perimeter of the plate. The liquid channeling plate is disposed within the press pan and communicating with the vertical wall along the wall circumference at the bottom of the press basket and the flat bottom of the press pan for providing a perimeter seal along a circumference at the bottom of a loaded press basket, thereby preventing the escape of undesirable sludge from the bottom of the press basket into the press pan.

The holes and channels of the liquid channeling plate also provide a means for efficient evacuation of pressed juice from the bottom of the press basket into the press pan by providing a lower resistance downward pathway for trapped pockets of juice to escape during the press process.

Another object of the present invention is to provide an integral removable reservoir disposed within the press frame and located at least partially beneath the press pan drain for retaining an extracted liquid received from the press pan that would allow the wine maker to hold an entire batch of liquid from the press process in order to ascertain the quality of the entire batch before transferring the liquid for further processing. The reservoir is provided with a spout for transferring the collected liquid from the reservoir.

Another object of the present invention is to provide a juice press with a hydraulic press basket lift that raises and holds the press basket after a press operation is completed and allows the press mechanism to be used to eject a disk of compressed solids from the bottom of the raised press basket.

The foregoing and other objects, features and advantages of the invention will be apparent from the following detailed description of a preferred embodiment of the invention, which is given by way of a non-limiting example with reference to the accompanying drawings.

SUMMARY OF THE INVENTION

A juice press as used in the production of wine for removing liquids from solids, having a horizontally positionable press frame that allows a vertical press mechanism to be rolled to a first position for interference-free loading of a press basket with material to be pressed, and then rolled to a second operating position located over the press basket. The press basket has a liquid channeling plate having an arrangement of holes and channels that creates a perimeter seal along a circumference at the bottom of a loaded press basket. The liquid channeling plate traps naturally occurring sludge along the circumference bottom and allows for efficient evacuation of extracted juice from the bottom of the basket as the press mechanism is operated. In one embodiment, the press frame is configured with a hydraulic press basket lift that raises and holds the press basket after a press operation is completed and allows the press mechanism to be used to eject a disk of compressed solids from the bottom of the raised press basket.

DETAILED DESCRIPTION OF THE INVENTION

Figure 1:
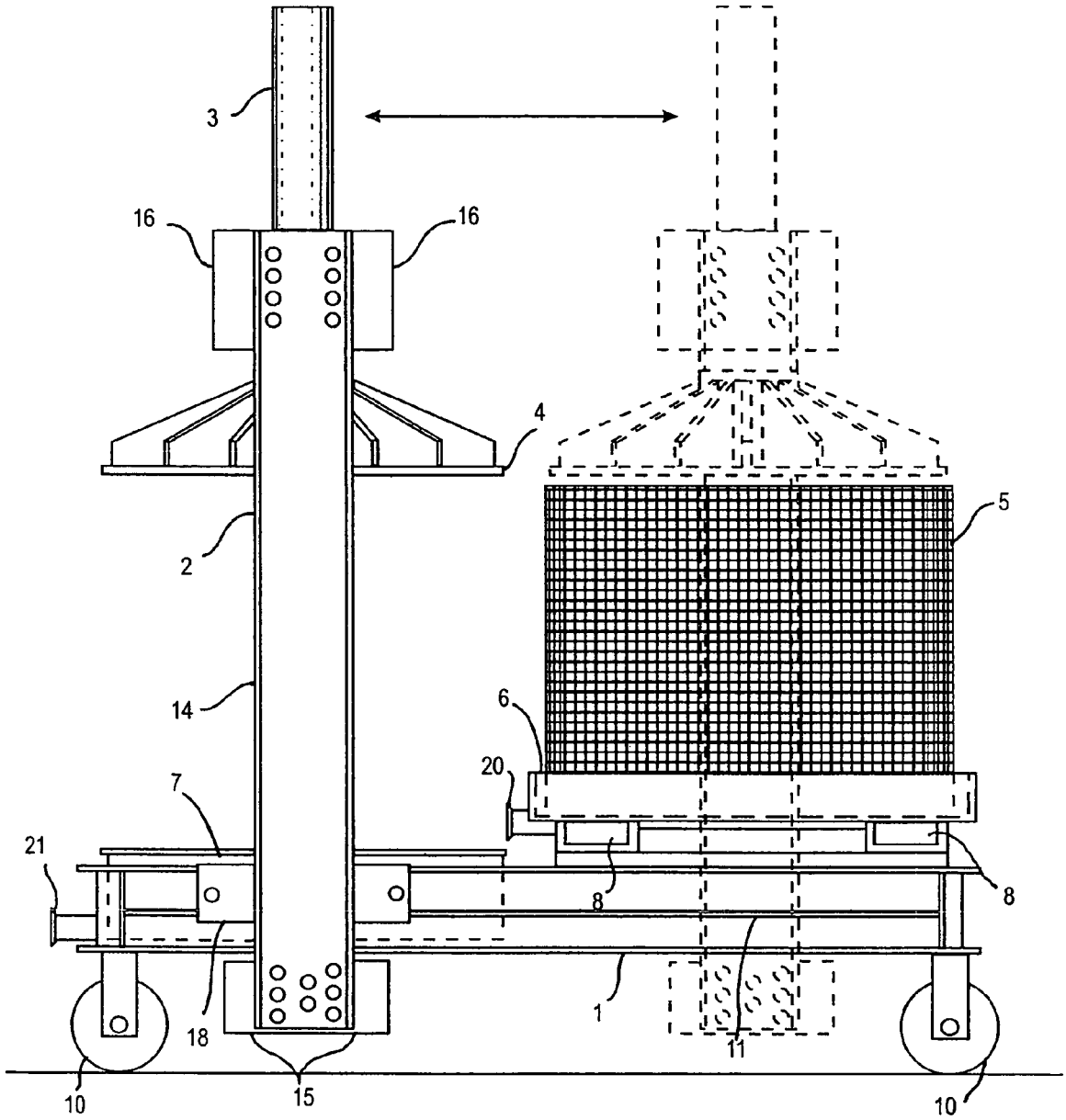
FIG. 1 is a side elevation of a preferred embodiment of the present invention showing alternate positions of a positionable vertical press frame.
Figure 2:
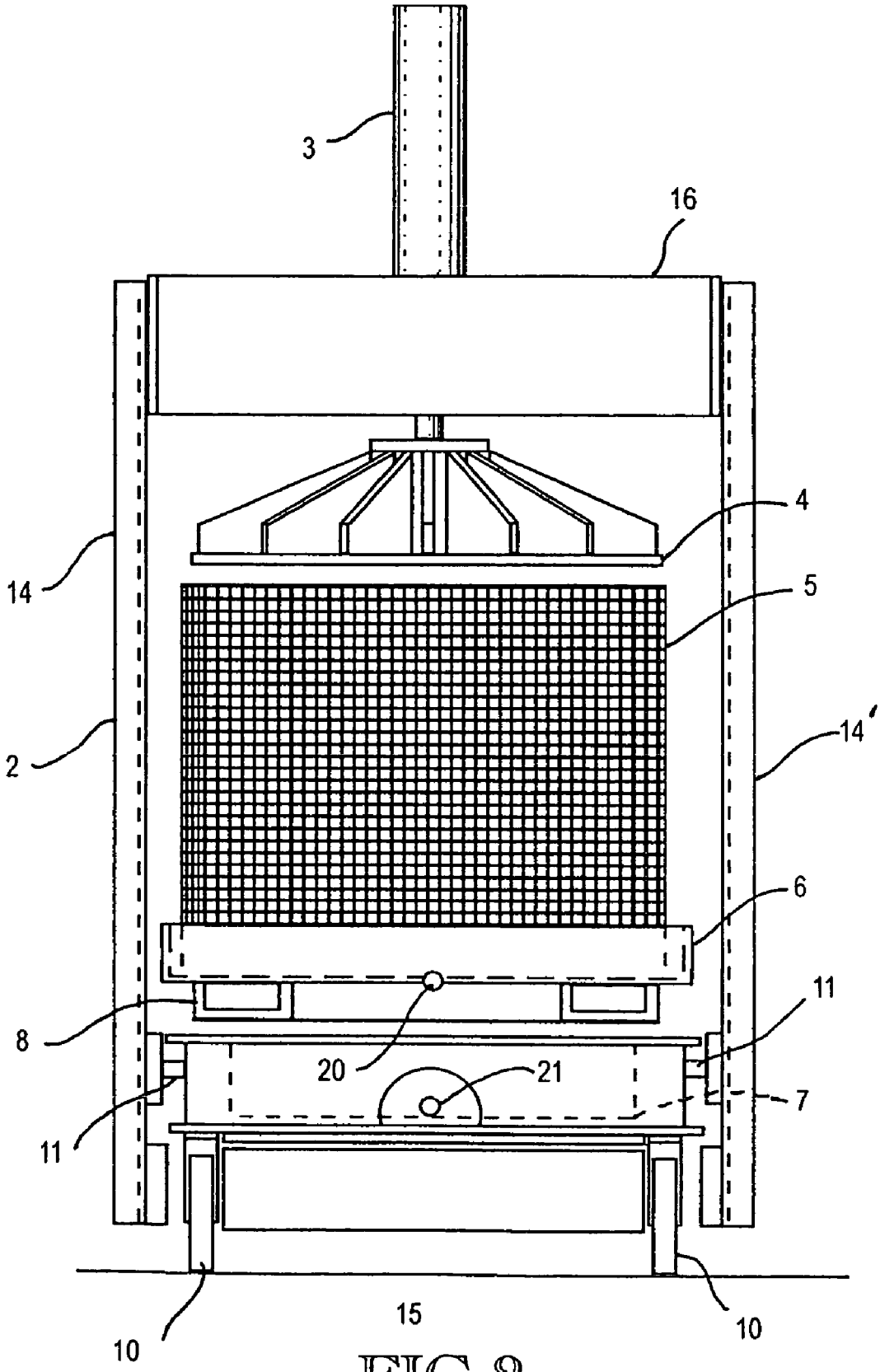
FIG. 2 is an end elevation of a preferred embodiment of the present invention.
Figure 3:
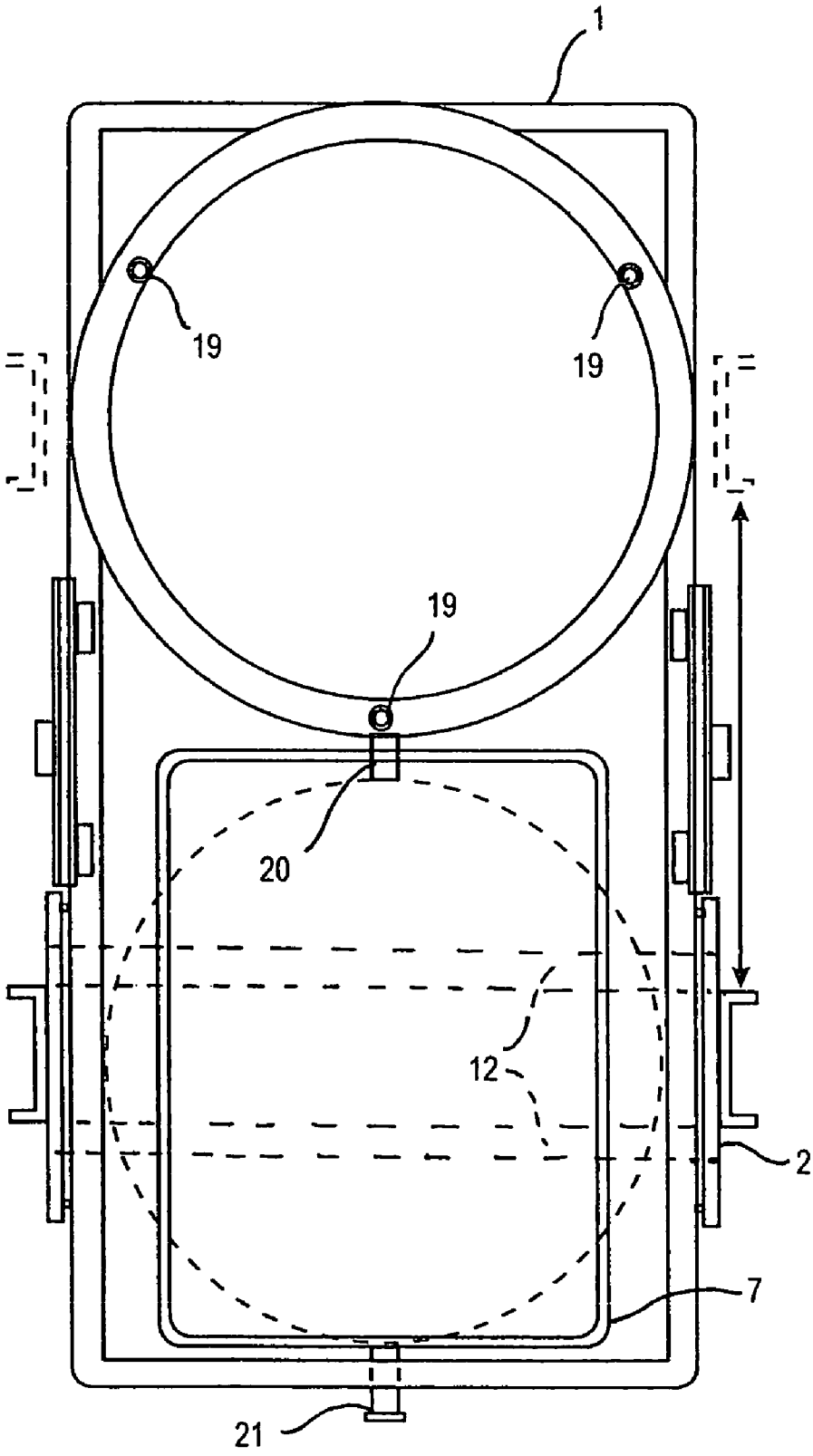
FIG. 3 is a plan view of a preferred embodiment of the present invention.

Referring to FIGS. 1, 2 and 3, a preferred embodiment of a wine press of the present invention consists of a rectangular horizontal frame 1, a vertical rolling frame 2 that holds a hydraulic or pneumatic ram 3, a circular press plate 4, a perforated circular press basket 5 and press pan 6, and a reservoir tub 7. The press pan 6 holding the perforated basket 5 is attached to a framework 8 having pockets, as might be fabricated of box steel members, that allows the arms of a forklift to be inserted securely in order to pick the press pan up. As shown in FIG. 3, the location of the press basket 5 rests within the press pan 6 that is contained within the horizontal frame 1. A press cycle is initiated with the filling of the press basket 5 with the material to be pressed. While the press basket 5 is being filled, the vertical frame 2 remains in a first position at the end of the horizontal frame 1 opposite the end where the press basket 5 is located. This allows for interference-free loading of the press basket. Once the press basket 5 is filled, the vertical frame 2 is positioned over the basket 5 to begin the pressing. On completion of pressing, the vertical frame rolls back to the non-basket end of the press for convenient basket removal.

In a preferred embodiment, a fluid dispersion plate 9, as shown in FIGS. 5, 6A, 6B, and 6C, is placed in the basket before adding the fermented juice and skins.

Figure 4:
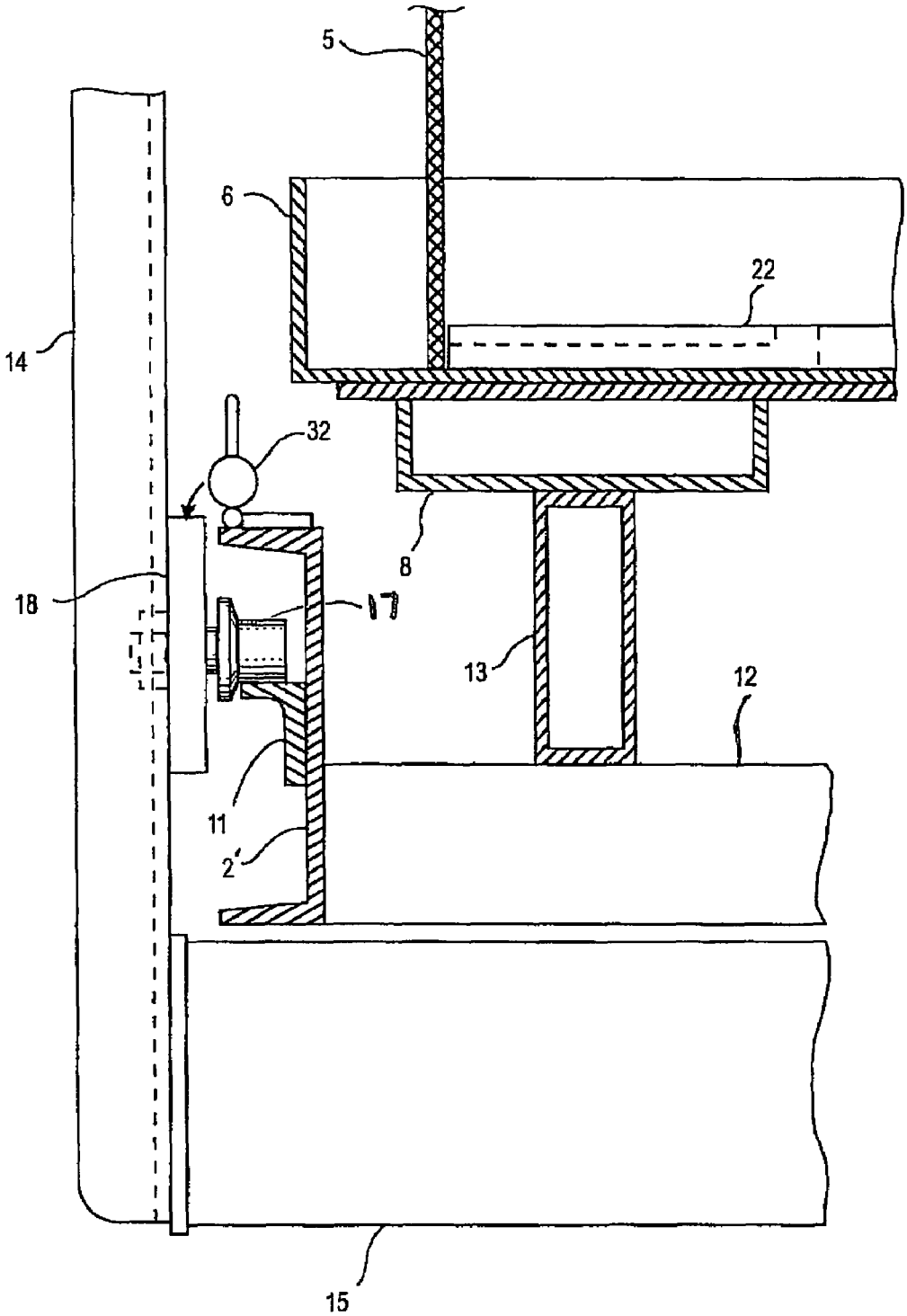
FIG. 4 is an elevation section.

Referring to FIGS. 1 and 2, the horizontal framework 1 provides the basic support for the wine press. It consists of welded or bolted mild steel channel frame, fabricated in a rectangular shape. The web of the channel is upright, and the vertical face faces inward. Each corner is supported at the proper distance off the ground with either fixed legs, or caster wheels 10. A continuous horizontal track or rail 11 is attached to the outside face of the web on both of the long legs of the rectangle. A close-up cross-sectional view of the track 11 is shown in FIG. 4. The track 11 is located at the approximate midpoint of the channel. There are fixed support members 12 between the channels. These support members 12 align with the bottom pair of cross beams 13 that are a part of the vertical frame 2. Additionally, the fixed support members 12 have pallet type supports perpendicular and above them. This pallet support assembly is directly under and centered on the press basket pan. Additional cross supports are provided for the reservoir pan.

Referring to FIGS. 1 and 2, vertical frame 2 consists of two vertical support channels 14 and 14' on either side of the horizontal frame 1, extending from the two bottom beams 15 to the two top beams 16. Both sets of cross beams are structurally attached to the vertical support channels 14 and 14'. The hydraulic ram 3 is attached at the center of the two top beams 16. The vertical frame 2 rolls laterally on the horizontal frame 1. This is accomplished by two roller wheels 17 on either side of the vertical frame 2 as shown in FIG. 4. The roller wheels 17 are mounted on a horizontal support 18 as shown in FIG. 1. Each wheel is at an equal distance from the vertical centerline of the frame 2 in order to provide balance and resistance to overturning. The top of the bottom beams 15 of the vertical frame are set slightly below the bottom of the horizontal frame 1 in the resting position. This allows the vertical frame 2 to roll back and forth. A locking means 32 affixed to the horizontal frame 1 for releasably engaging the roller wheels 17 to secure the vertical frame 2 in a desired position along the longitudinal length of the horizontal frame 2'.

The vertical frame 2 holds a hydraulic or pneumatic ram 3 that is centrally mounted on a vertical axis on the top member of the vertical frame 2. The ram 3 is affixed to the top member to provide downward force of a circular press plate 4 that is attached to the ram 3.

The ram 3 may be either hydraulic, pneumatic or motorized and is sized to apply sufficient pressure to extract all or most of the liquid out of the fermented grapes/wine. The ram 3 is affixed to the top of the vertical frame, oriented in a position that allows for downward actuation of the press plate 4 into the press basket 5 in a compression stage, and upward retraction to withdraw the press plate 4 from the press basket 5. The ram 3 should have controls for both high and low speed operation in both directions. In a preferred embodiment, the power unit is remote and attached to the press assembly with quick disconnects.

When sufficient hydraulic force is applied to the skins and wine in the basket 5, the vertical frame 2 rises and makes contact with the cross framework 12, 13 directly under the press pan 6. The content of the basket 5 is under continuous pressure. Forces are resolved directly through the framework 12, pallet 13, forklift framework 8, and press pan 6, until pressure is released.

Figure 5:
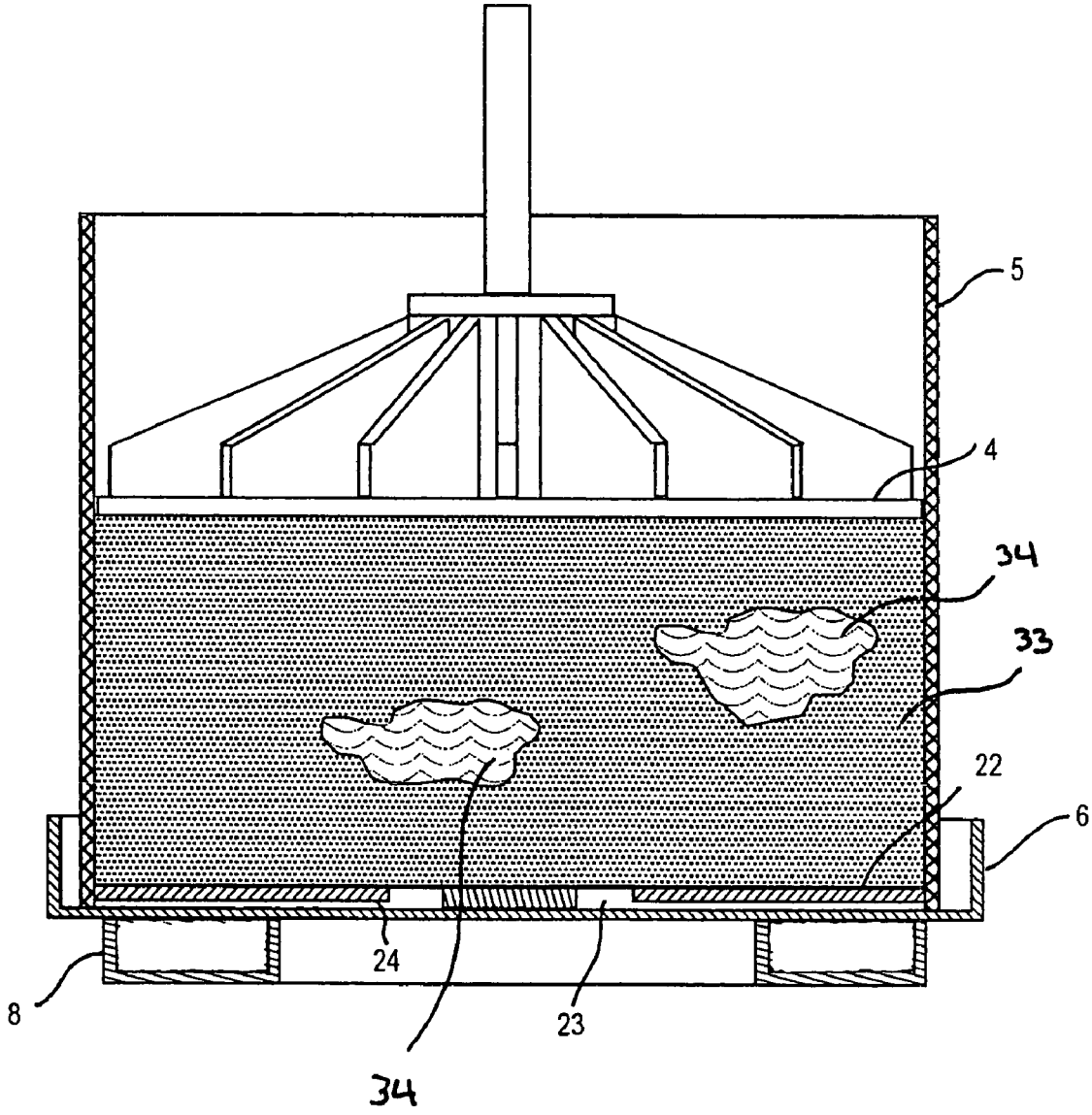
FIG. 5 is an elevation section of a press basket of the present invention.

Referring to FIGS. 1, 2 and 5, a circular press plate 4 fits with close tolerance inside the press basket 5. It is structurally attached to the hydraulic ram 3, and is reinforced to withstand the applied pressures. The press plate 4 as shown is reinforced with a plurality of radially disposed steel fins welded to a central collar and welded to the top of the press plate body. In an alternate embodiment, the press plate is constructed of a solid disk of steel, the thickness and strength of the steel providing the necessary reinforcement.

The press pan 6 is a flat pan with vertical sides and a drain 20 for the wine to be released into a reservoir pan 7 as shown in FIG. 1. In alternate embodiments, the drain 20 is fitted with an adjustable valve for regulation of outflowing wine. The diameter of the press pan 6 is substantially larger than the press basket 5 to allow wine to flow out of the basket 5 to the drain 20. The bottom of the press basket 5 is attached to a slotted assembly 8 that allows the press basket 5 to be picked up by a forklift and rotated to invert the press basket 5 for emptying.

The press basket 5 is a circular perforated basket essentially defining a cylindrical shape. In one embodiment, the basket may be divided in two or three vertical sections, flexibly connected to each other with structural connectors such as hinge pins 19 (as shown in FIG. 3), or it may be continuous circular elements that stack neatly on top of each other. Also, it may be a combination of both of these options. Vertical divisions must be connected with structural connectors designed to resist hoop pressures generated by the vertical force provided by the ram 3. In an alternate embodiment, the press basket is a single-piece continuous circular element having vertical walls that essentially define a cylinder. A typical press basket 5 as shown has a 42 inch outside diameter and has a capacity for holding 60 tons of material to be pressed.

The reservoir pan 7 for collecting the extracted liquid received from the press pan 6 is an open container disposed within the horizontal frame 1 and allows the wine maker to hold an entire batch of liquid from the press process in order to ascertain the quality of the entire batch before transferring the liquid for further processing. This is especially important for making white wine, where it is desirable for the wine maker to visually ascertain and inspect the clarity and percent of suspended solids in the juice at the time of pressing.

The reservoir pan 7 is disposed within the horizontal framework 1 at a location beneath the drain 20 of the press pan 7 allowing liquid to drain from the press pan 6 into the reservoir pan 7. The reservoir pan 7 also provides overflow safety integral to the wine press that guards against potential overflow of the press pan 6 that would otherwise result in loss of product. The reservoir pan 7 is sized to hold a substantial amount of wine, preferably at least one barrel, or about 60 U.S. gallons, and is easily removable for cleaning. The reservoir pan 7 has a wine spout 21 that allows connection to hoses, pipes or other conduit for transfer of wine to barrels or tanks. In alternate embodiments, the spout 21 is fitted with an adjustable valve for regulation of outflowing wine.

The reservoir pan 7 further allows the wine maker the ability to chemically treat the wine as one lot, or the option of blending the various flavors extracted at different phases of the press cycle before transferring to a barrel for storage. In one embodiment, the reservoir pan 7 is graduated or calibrated so that the quantity of remaining fluid may be matched with an appropriately sized storage container.

Referring to FIG. 5, a filled press basket 5 is shown disposed within a press pan 6. A removable liquid channeling plate 22 is placed at the bottom of the press basket 5 prior to filling. The compressing mixture 33 of material to be pressed develops pockets of liquid 34 as the mixture 33 becomes more solid as it compacts.

Figure 6A:
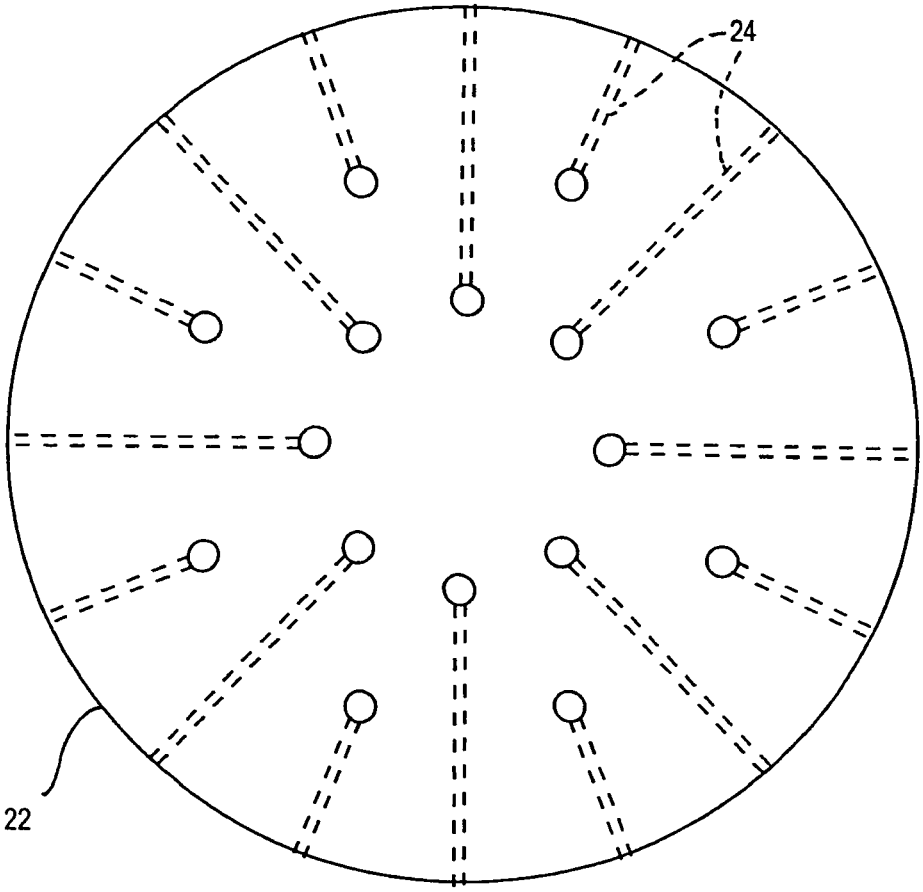
FIG. 6A is a plan view of a preferred embodiment of a liquid channeling plate of the present invention.
Figure 6B:
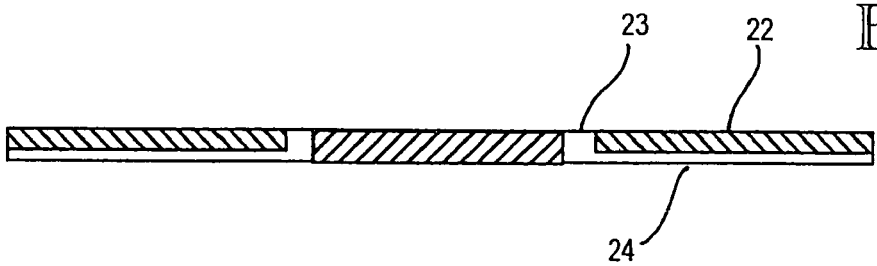
FIG. 6B is an elevation of the liquid channeling plate shown in FIG. 6A.
Figure 6C:
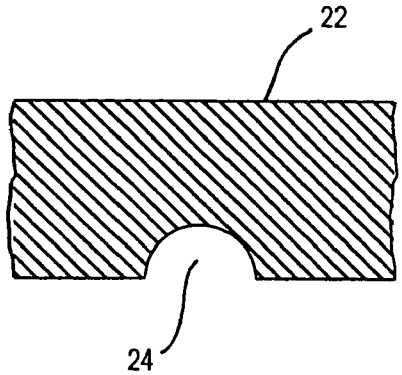
FIG. 6C is an elevation section of a liquid channeling plate.

Referring to FIGS. 6A, 6B and 6C, a removable liquid channeling plate 22, comprising a sanitary disc of about 1-inch thickness and having an outside edge defined by the perimeter of the disk having a like shape and dimensions as the inside bottom of the press basket 5, is placed within the press pan 6 to form a bottom portion of the press basket 5 when the press basket is fitted into the press pan 6.

As pressure is applied by the ram 3 and pressure plate 4 downward into the press basket filled with the mixture of must and pomace, pockets of fluid become trapped within compressing mixture. The liquid becomes trapped because the compressing mixture increasingly acts as a solid disallowing the passage of liquid from the center regions of the mixture to the perforated walls of the press basket 5. As pressure from the press is increased, these pockets can eventually overcome their entrapment and be forcefully ejected laterally, often times creating further waste of product, creating problems of workplace cleanliness, and raising the possibility of injury.

The liquid dispersion plate 22 alleviates this problem by allowing the pockets of liquid 34 to escape by way of lower resistance pathways downward through the bottom of the compressing mixture 33. The face of the wine dispersion plate 22 has a pattern of large holes 23 extending through the plate 22. Each hole 23 has a half-round liquid transfer slot 24 milled into the bottom of the plate 22. These slots 24 extend radially from each hole location to the outer perimeter of the plate and out to the outside edge of the plate such that liquid escaping from the bottom of the compressed must and pomace mixture is allowed to pass through each hole 23, travel through the slots 24 outward to the perimeter of the lower edge of the press basket 5, passing through the basket wall perforations and into the press pan 6.

Figure 7:
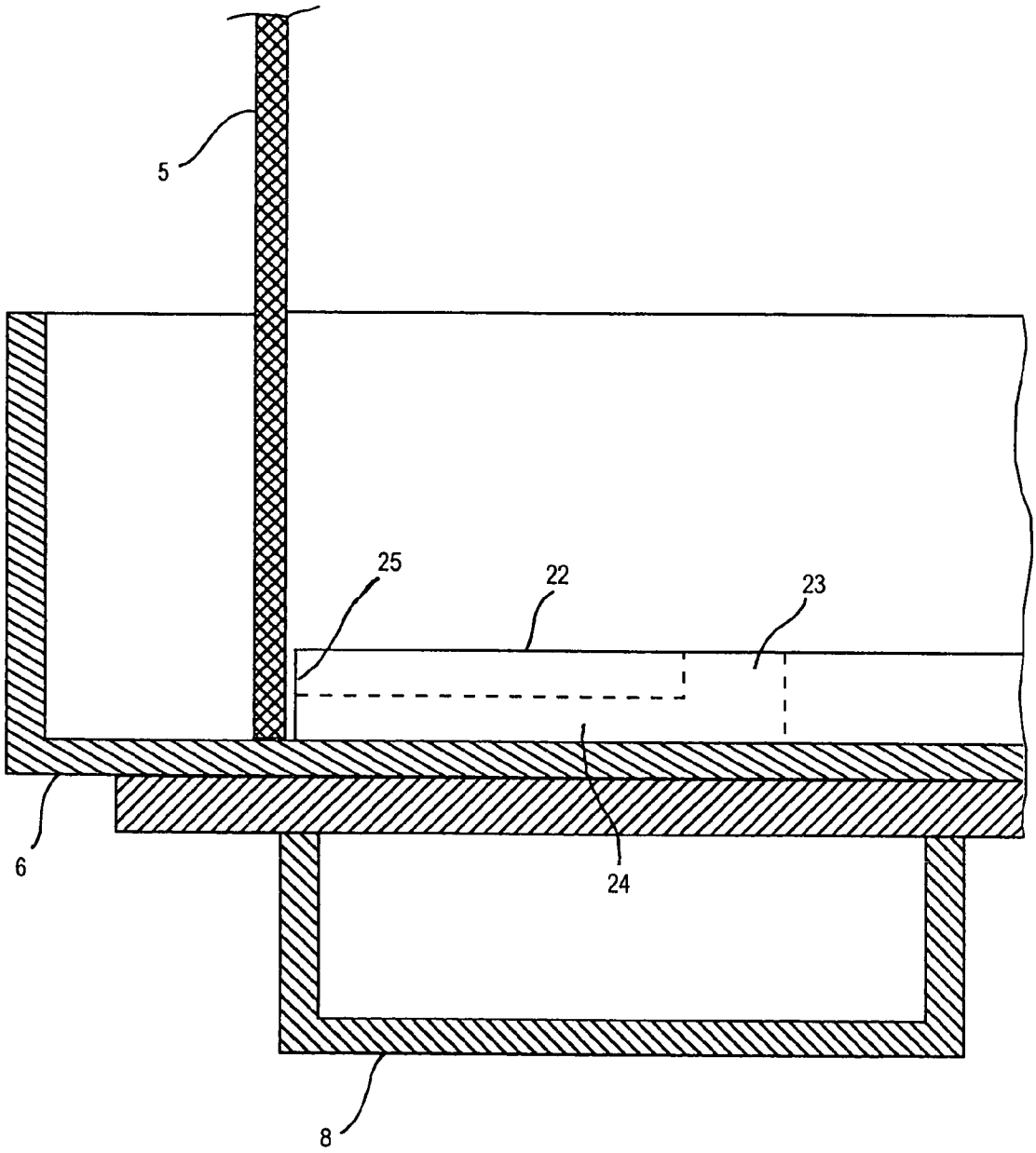
FIG. 7 is an elevation section showing a close-up view of a liquid channeling plate relative to a press basket and press pan.

The other important function of the liquid dispersion plate 22 is to provide a spacer for the vertical distance between the must and pomace mixture and the bottom edge of the press basket 5, as shown in FIG. 7. The presence of this spacer alleviates the problem of escaping sludge around the bottom edge of the press basket that otherwise occurs as grape skins are forced under the press basket 5 by the tremendous pressure exerted by the ram 3 and press plate 4. Sludge ordinarily forms as heavier particulate matter settles within the must and pomace mixture, particularly in the lower portion of the press basket 5 and press pan 6 prior to compression. Sludge is troublesome if it is allowed to escape into the press pan 6 because it can contaminate the outflowing liquid and otherwise foul filters and pumps, resulting in waste, production inefficiencies, and undesirable wine characteristics.

FIG. 7 shows a close-up section view of one outside edge 25 of a liquid dispersion plate 22 having a hole 23 through the plate 22, and a slot 24 on the bottom side of the plate 22 providing a channel from the hole 23 to the outside perimeter of the plate 22, and providing a spacer between the bottom of the press basket 5 and the press pan 6. At the beginning of the press operation, the dispersion plate 22 is placed within the press pan 6, and an empty press basket 5 is then inserted within the press pan 6 and fitted snugly over the dispersion plate 22. The outside edge 25 of the dispersion plate 22 makes continuous contact with the bottom perimeter of the press basket 5, which itself makes continuous contact with the press pan 6. As the press basket 5 is filled with a mixture of must and pomace, the contact between the outside edge 25 of the liquid dispersion plate 22 and the bottom perimeter of the press basket prevents grape skins from being forcefully pushed under the press basket 5, which would allow the escape of undesirable sludge.

Figure 8:
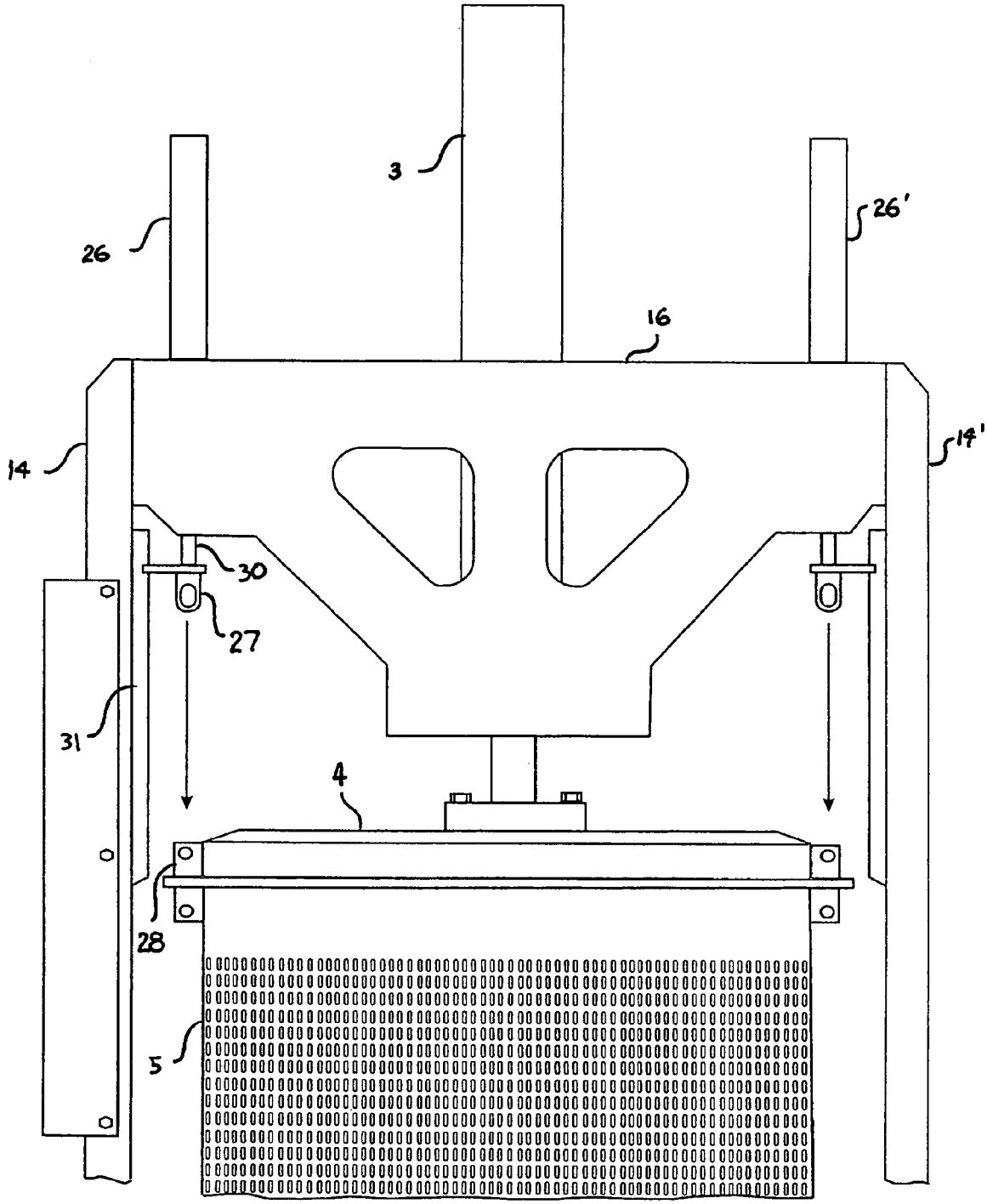
FIG. 8 is a section view of a vertical frame showing one embodiment of a press basket lift prior to engagement with the press basket.
Figure 9:
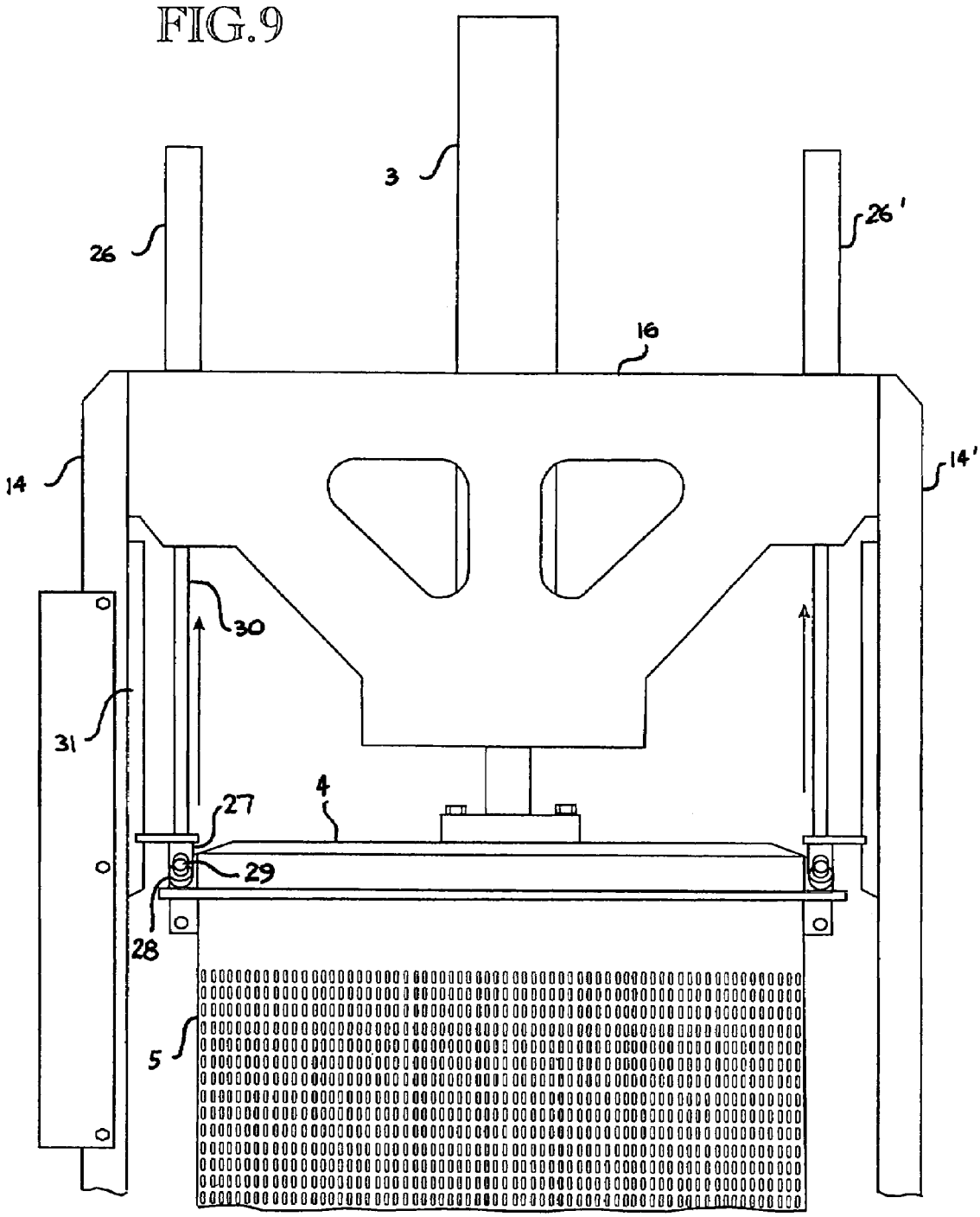
FIG. 9 is a section view of a vertical frame showing one embodiment of a press basket lift while engaged with the press basket.

FIG. 8 and FIG. 9 are section views of a vertical press frame of another embodiment having a means for lifting and supporting the press basket after completion of a juice extraction cycle while the centrally mounted powered ram is used to push the press plate downward to eject a compressed cake of the skins and other solids.

The means for lifting and supporting the press basket in FIG. 8 and FIG. 9 show two powered lift rams 26 and 26' mounted on a vertical axis on either side of the top of the vertical frame 2, each lift ram having a lift arm 30 that is movable in a downward direction and retractable in an upward direction, and a balancing means (not shown) that allows the lift rams to operate in unison. The end of each lift arm 30 furthest from each powered lift ram 26 is affixed to a releasable connection means 27 such as a clevis. Each connection means engages a corresponding releasable connection means, such as a clevis 28 and removable clevis pin 29, located on the upper vertical wall of the press basket 5. A pair of vertical guides 31 are attached to the vertical support channels 14 and 14' in order to guide the connection means 27 to their corresponding locations on the press basket 5 and to provide lateral strength and rigidity to the lift arms 30.

Following a press cycle, the lift arms 30 are lowered (as shown in FIG. 8) to a position to allow attachment to the press basket 5, and then retracted to lift and support the press basket while a compressed cake is ejected by the downward motion of the press plate 4 powered by the hydraulic ram 3.

INDUSTRIAL APPLICABILITY

The present invention has applicability to the field of juice presses as used by wine producers, and more particularly to a wine press for improving efficiencies of wine production and for reducing waste and lost time during the press process.

In compliance with the statute, the invention has been described in language more or less specific as to juice and wine presses. It is to be understood, however, that the invention is not limited to the specific means or features shown or described, since the means and features shown or described comprise preferred ways of putting the invention into effect.

Additionally, while this invention is described in terms of being used for a wine press, it will be readily apparent to those skilled in the art that the invention can be adapted to other uses for other forms of juice, vegetable, and food processing, and therefore the invention should not be construed as being limited to wine production. The invention is, therefore, claimed in any of its forms or modifications within the legitimate and valid scope of the appended claims, appropriately interpreted in accordance with the doctrine of equivalents.

We claim:

1. A juice press as used in a production of juice or wine from grapes, fruit, or like material for separating extracted fluid from skins and other solids, comprising:

a horizontal frame having a first end, a second end, a top, a base, two essentially parallel sides and at least one support means mounted to each of the two essentially parallel sides and running longitudinally from the first end to the second end;

a vertical frame having a top member and a horizontal bottom member, two vertical sides, and at least one support member affixed to the vertical frame and communicating with the support means of the horizontal frame for allowing longitudinal positioning of the vertical frame with respect to the horizontal frame, whereby the vertical frame of the juice press is rolled to a first position for interference-free loading of a press basket with material to be pressed, and then rolled to a second operating position for performing a press operation;

a powered ram centrally mounted on a vertical axis on the top member of the vertical frame, movable in a downward direction and retractable in an upward direction;

a press plate affixed to the powered ram and located to provide downward force by the powered ram onto the grapes, fruit, or like material to be pressed, the press plate comprising an essentially flat bottom surface and an upper surface connected to the powered ram, whereby the powered ram applies a downward force with the press plate onto material to be pressed;

a press pan for capturing extracted fluid from the material to be pressed, disposed horizontally within the second end of the horizontal frame, said pan comprised of a flat bottom, a continuous vertical wall and an open top, defining an essentially cylindrical volumetric space, and a spout located along the vertical wall for evacuation of captured fluid;

a removable press basket disposed within the press pan and comprised of a cylindrical receptacle having an essentially continuous vertical wall having a plurality of perforations through which extracted fluid will pass from within the basket, an open top having a shape and diameter consistent with that of the press plate, and an open bottom defined by the circumference of the vertical wall, whereby the bottom of the vertical wall contacts the press pan;

a reservoir for retaining extracted fluid received from the press pan, disposed within the horizontal frame and located beneath a press pan drain, comprised of a bottom, a vertical containment wall and an open top defining a volumetric space, and a drain for evacuation of captured fluid.

2. The juice press of claim 1, whereby the support means of the horizontal frame comprises a track.

3. The juice press of claim 2 further comprising a locking means releasably engaging the vertical frame in a desired position along the longitudinal length of the horizontal frame.

4. The juice press of claim 1, wherein the press pan is comprised of pockets affixed beneath the flat bottom of the press pan, whereby the press pan is removable from the horizontal frame by mechanical means, for loading and unloading the press pan and press basket.

5. The juice press of claim 1 further comprising a liquid channeling plate comprising:

a top surface; a bottom surface; and an outer edge defining the shape of a flat disk having a shape and diameter consistent with that of the bottom of the press basket, a plurality of openings in the top surface extending through the disk to the bottom surface, and a plurality of grooved channels on the bottom surface of the disk extending radially from the openings to the outer edge, whereby the openings and channels of the liquid channeling plate provide a means for efficient evacuation of pressed juice from the bottom of the press basket into the press pan by providing a lower resistance downward pathway for trapped pockets of juice to escape during a press process;

the liquid channeling plate being disposed within the press pan of the juice press and communicating with the vertical wall along the wall circumference at the bottom of the press basket and the flat bottom of the press pan, whereby, during a press operation of the juice press, the liquid channeling plate provides a perimeter seal along a circumference at the bottom of the press basket, thereby preventing the escape of undesirable sludge from the bottom of the press basket into the press pan, and for allowing evacuation of extracted fluid from the bottom of the press basket.

6. The juice press of claim 2 further comprising a liquid channeling plate comprising:

a top surface; a bottom surface; and an outer edge defining the shape of a flat disk having a shape and diameter consistent with that of the bottom of the press basket, a plurality of openings in the top surface extending through the disk to the bottom surface, and a plurality of grooved channels on the bottom surface of the disk extending radially from the openings to the outer edge, whereby the openings and channels of the liquid channeling plate provide a means for efficient evacuation of pressed juice from the bottom of the press basket into the press pan by providing a lower resistance downward pathway for trapped pockets of juice to escape during a press process;

the liquid channeling plate being disposed within the press pan of the juice press and communicating with the vertical wall along the wall circumference at the bottom of the press basket and the flat bottom of the press pan, whereby, during a press operation of the juice press, the liquid channeling plate provides a perimeter seal along a circumference at the bottom of the press basket, thereby preventing the escape of undesirable sludge from the bottom of the press basket into the press pan, and for allowing evacuation of extracted fluid from the bottom of the press basket.

7. The juice press of claim 3 further comprising a liquid channeling plate comprising:

a top surface; a bottom surface; and an outer edge defining the shape of a flat disk having a shape and diameter consistent with that of the bottom of the press basket, a plurality of openings in the top surface extending through the disk to the bottom surface, and a plurality of grooved channels on the bottom surface of the disk extending radially from the openings to the outer edge, whereby the openings and channels of the liquid channeling plate provide a means for efficient evacuation of pressed juice from the bottom of the press basket into the press pan by providing a lower resistance downward pathway for trapped pockets of juice to escape during a press process;

the liquid channeling plate being disposed within the press pan of the juice press and communicating with the vertical wall along the wall circumference at the bottom of the press basket and the flat bottom of the press pan, whereby, during a press operation of the juice press, the liquid channeling plate provides a perimeter seal along a circumference at the bottom of the press basket, thereby preventing the escape of undesirable sludge from the bottom of the press basket into the press pan, and for allowing evacuation of extracted fluid from the bottom of the press basket

8. The juice press of claim 1, further comprising a means for lifting and supporting the press basket after completion of a juice extraction cycle while the centrally mounted powered ram is used to push the press plate downward to eject a compressed cake of the skins and other solids.

9. The juice press of claim 2, further comprising a means for lifting and supporting the press basket after completion of a juice extraction cycle while the centrally mounted powered ram is used to push the press plate downward to eject a compressed cake of the skins and other solids.

10. The juice press of claim 3, further comprising a means for lifting and supporting the press basket after completion of a juice extraction cycle while the centrally mounted powered ram is used to push the press plate downward to eject a compressed cake of the skins and other solids.

11. The juice press of claim 8, wherein the means for lifting and supporting the press basket is comprised of a plurality of powered lift rams, each lift rain further comprised of a lift arm, movable in a downward direction and retractable in an upward direction, a releasable connection means at the end of the lift arm; and a corresponding releasable connection means located on the vertical wall of the press basket, whereby the lift arms are lowered to a position to allow attachment to the press basket, and then retracted to lift and support the press basket while the compressed cake is ejected.

12. A juice press as used in a production of juice or wine from grapes, fruit, or like material for separating extracted fluid from skins and other solids, comprising:

a horizontal frame having a first end, a second end, a top, a base, two essentially parallel sides and at least one support means mounted to each of the two essentially parallel sides and running longitudinally from the first end to the second end;

a vertical frame having a top member and a horizontal bottom member, two vertical sides, and at least one support member affixed to the vertical frame and communicating with the support means of the horizontal frame, whereby the vertical frame is longitudinally positionable along the horizontal frame from a location at the first end to a location at the second end;

a powered ram centrally mounted on a vertical axis on the top member of the vertical frame, movable in a downward direction and retractable in an upward direction;

a press plate affixed to the powered ram and located to provide downward force by the powered ram onto the grapes, fruit, or like material to be pressed, the press plate comprising an essentially flat bottom surface, an upper surface connected to the powered ram;

a removable press pan for capturing extracted fluid, disposed horizontally within the second end of the horizontal frame, said pan comprised of a flat bottom, a continuous vertical wall and an open top, defining an essentially cylindrical volumetric space, and a spout for evacuation of captured fluid;

a removable press basket disposed within the press pan and comprised of a cylindrical receptacle having an essentially continuous vertical wall having a plurality of perforations through which extracted fluid will pass from within the basket, an open top having a shape and diameter consistent with that of the press plate, and an open bottom defined by the circumference of the vertical wall, whereby the bottom of the vertical wall contacts the press pan;

a liquid channeling plate disposed within the press pan and communicating with the vertical wall at the bottom of the press basket and the flat bottom of the press pan for preventing the escape of undesirable sludge from the bottom of the press basket into the press pan, and for allowing evacuation of extracted fluid froth the bottom of the press basket, the liquid channeling plate comprising a top surface; a bottom surface; and an outer edge defining the shape of a flat disk having a shape and diameter consistent with that of the bottom of the press basket, a plurality of openings in the top surface extending through the disk to the bottom surface, and a plurality of grooved channels on the bottom surface of the disk extending from the openings to the outer edge;

a reservoir for retaining extracted fluid received from the press pan, disposed within the horizontal frame and located beneath a press pan drain, comprised of a bottom, a vertical containment wall and an open top defining a volumetric space, and a drain for evacuation of captured fluid.

13. A juice press as used in a production of juice or wine from grapes, fruit, or like material for separating extracted fluid from skins and other solids, comprising:

a horizontal frame having a first end, a second end, a top, a base, two essentially parallel sides and at least one support means mounted to each of the two essentially parallel sides and running longitudinally from the first end to the second end;

a vertical frame having a top member and a horizontal bottom member, two vertical sides, and at least one support member affixed to the vertical frame and communicating with the support means of the horizontal frame for allowing longitudinal positioning of the vertical frame with respect to the horizontal frame, whereby the vertical frame of the juice press is rolled to a first position for interference-free loading of a press basket with material to be pressed, and then rolled to a second operating position for performing a press operation;

a powered ram centrally mounted on a vertical axis on the top member of the vertical frame, movable in a downward direction and retractable in an upward direction;

a press plate affixed to the powered ram and located to provide downward force by the powered ram onto the grapes, fruit, or like material to be pressed, the press plate comprising an essentially flat bottom surface and an upper surface connected to the powered ram, whereby the powered ram applies a downward force with the press plate onto material to be pressed;

a press pan for capturing extracted fluid from the material to be pressed, disposed horizontally within the second end of the horizontal frame, said pan comprised of a flat bottom, a continuous vertical wall and an open top, defining an essentially cylindrical volumetric space, and a spout located along the vertical wall for evacuation of captured fluid;

a removable press basket disposed within the press pan and comprised of a cylindrical receptacle having an essentially continuous vertical wall having a plurality of perforations through which extracted fluid will pass from within the basket, an open top having a shape and diameter consistent with that of the press plate, and an open bottom defined by the circumference of the vertical wall, whereby die bottom of the vertical wall contacts the press pan;

a reservoir for retaining extracted fluid received from the press pan disposed within the horizontal frame and located beneath a press pan drain, comprised of a bottom, a vertical containment wall and an open top defining a volumetric space, and a drain for evacuation of captured fluid a liquid channeling plate disposed within the press pan and communicating with the vertical wall along the wall circumference at the bottom of the press basket and the flat bottom of the press pan for providing a perimeter seal along a circumference at the bottom of a loaded press basket, thereby preventing the escape of undesirable sludge from the bottom of the press basket into the press pan, and for allowing evacuation of extracted fluid from the bottom of the press basket, the liquid channeling plate comprising a top surface; a bottom surface; and an outer edge defining the shape of a flat disk having a shape and diameter consistent with that of the bottom of the press basket, a plurality of openings in the top surface extending through the disk to the bottom surface, and a plurality of grooved channels on the bottom surface of the disk extending from the openings to the outer edge;

a means for lifting and supporting the press basket comprising a plurality of powered lift rams, each lift ram further comprised of a lift arm, movable in a downward direction and retractable in an upward direction; a releasable connection means at the end of the lift arm; and a corresponding releasable connection means located on the vertical wall of the press basket, whereby, after completion of a juice extraction cycle, the lift arms are lowered to a position to allow attachment of the lift arms to the press basket, and then retracted to lift and support the press basket while a compressed cake of the skins and other solids is ejected by downward force of the press plate.

14. A liquid channeling plate in combination with a juice press, the juice press is used in a production of juice or wine from grapes, fruit, or like material for separating extracted fluid from skins and other solids, the liquid channeling plate comprising:

a top surface; a bottom surface; and an outer edge defining the shape of a flat disk having a shape and diameter consistent with that of the bottom of a press basket, a plurality of openings in the top surface extending through the disk to the bottom surface, and a plurality of grooved channels on the bottom surface of the disk extending radially from the openings to the outer edge, whereby the openings and the channels of the liquid channeling plate provide a means for efficient evacuation of pressed juice from the bottom of the press basket into a press pan by providing a lower resistance downward pathway for trapped pockets of juice to escape during a press process;

the liquid channeling plate being disposed within the press pan of the juice press and communicating with a vertical wall along a wall circumference at the bottom of the press basket and a flat bottom of the press pan, whereby, during a press operation of the juice press, the liquid channeling plate provides a perimeter seal along a circumference at the bottom of the press basket, thereby preventing the escape of undesirable sludge from the bottom of the press basket into the press pan, and for allowing evacuation of extracted fluid from the bottom of the press basket.

* * * * *